US006733402B2

(12) United States Patent
Christensen

(10) Patent No.: US 6,733,402 B2
(45) Date of Patent: May 11, 2004

(54) GOLF BALL MARK REPAIR TOOL CONTAINING A SCORING PENCIL

(76) Inventor: Everett B. Christensen, 741 W. Gate Cir., Hawley, MN (US) 56549

( * ) Notice: Subject to any disclaimer, the term of this patent is extended or adjusted under 35 U.S.C. 154(b) by 0 days.

(21) Appl. No.: 10/237,256

(22) Filed: Sep. 5, 2002

(65) Prior Publication Data

US 2003/0032505 A1 Feb. 13, 2003

Related U.S. Application Data

(63) Continuation-in-part of application No. 09/870,980, filed on May 31, 2001, now abandoned.

(51) Int. Cl.[7] ..... A63B 57/00
(52) U.S. Cl. ..... 473/408
(58) Field of Search ..... 473/406, 408, 473/286; 224/918; D21/793, 795

(56) References Cited

U.S. PATENT DOCUMENTS

| | | | | | |
|---|---|---|---|---|---|
| 3,415,518 | A | * | 12/1968 | Root | 473/406 |
| 3,763,515 | A | * | 10/1973 | Voss | 473/408 |
| 3,905,525 | A | * | 9/1975 | Kawamata | 224/918 |
| 4,151,937 | A | * | 5/1979 | Jarosh et al. | 224/918 |
| 4,730,728 | A | * | 3/1988 | Larkin | 224/918 |
| D336,124 | S | * | 6/1993 | Ordlock | D21/793 |
| 5,388,824 | A | * | 2/1995 | Reimers | 473/408 |
| 6,024,654 | A | * | 2/2000 | Chun | 473/386 |
| 6,030,298 | A | * | 2/2000 | Tate | 473/408 |
| 6,050,905 | A | * | 4/2000 | Tate | 473/408 |

* cited by examiner

*Primary Examiner*—Steven Wong
(74) *Attorney, Agent, or Firm*—Curtis V. Harr

(57) ABSTRACT

A ball mark repair tool is provided which contains a method by which a scoring pencil can be held by the repair tool and removed or replaced as needed. This cuts down on the number of loose articles in a golfers pocket and prevents the loss of tools during play.

14 Claims, 6 Drawing Sheets

FIG 1
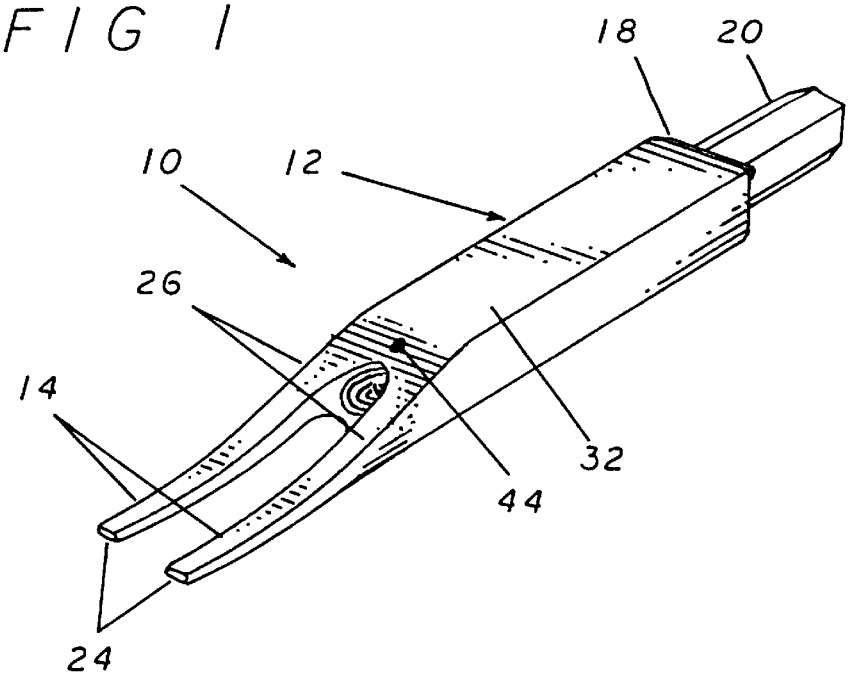
FIG 2
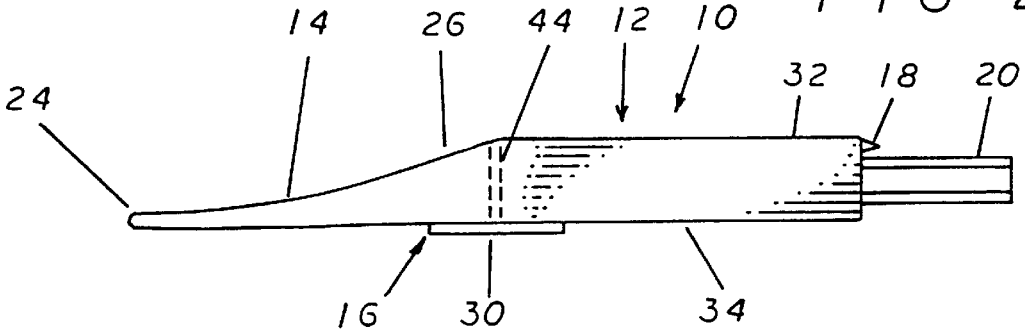
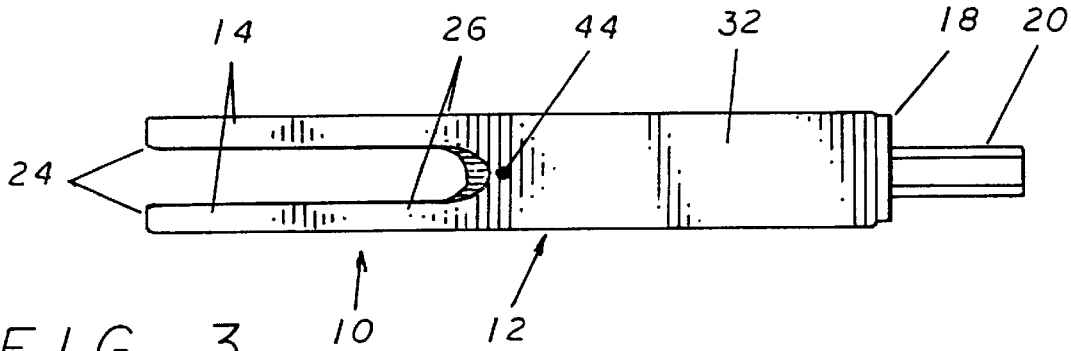
FIG 3

FIG 4
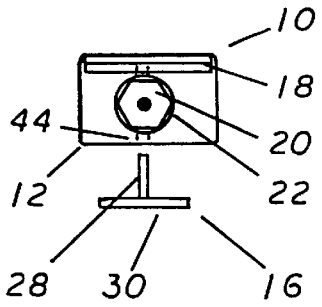
FIG 5
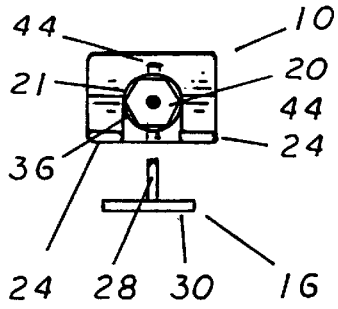
FIG 6
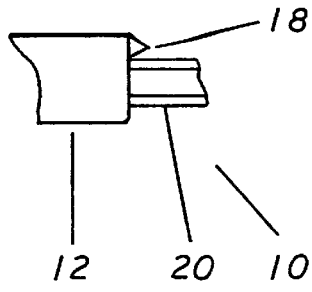
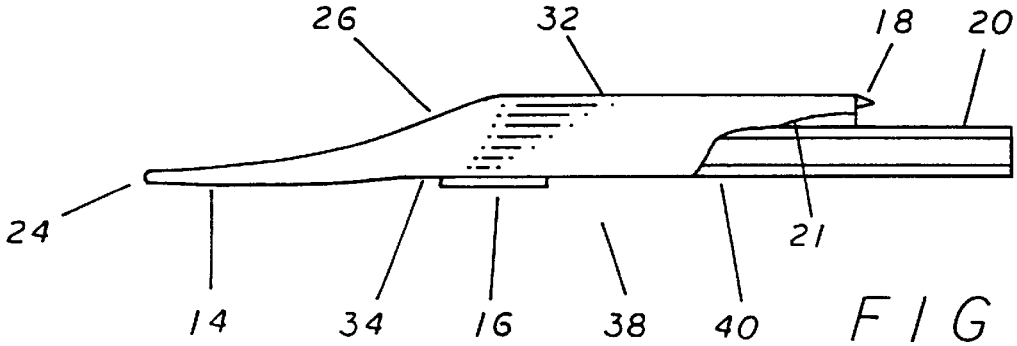
FIG 7
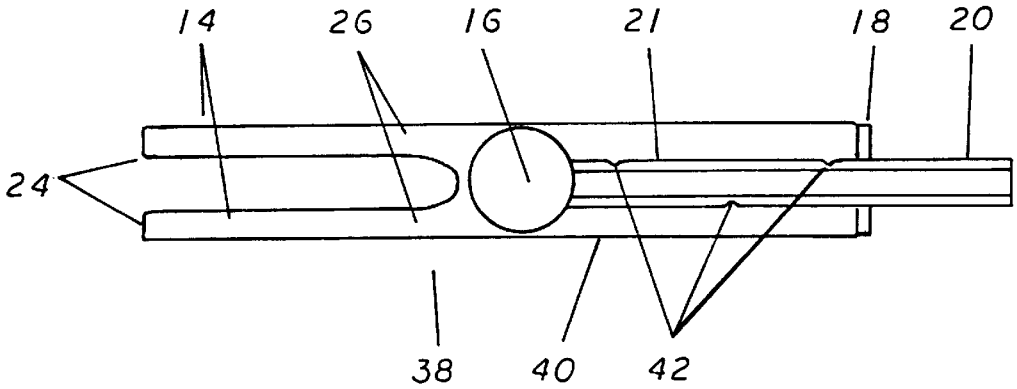
FIG 8

FIG 9
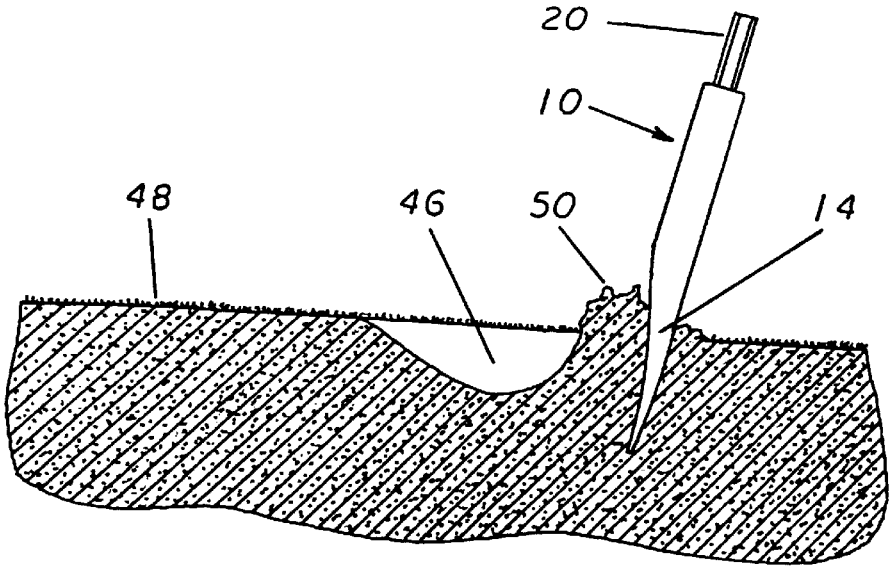
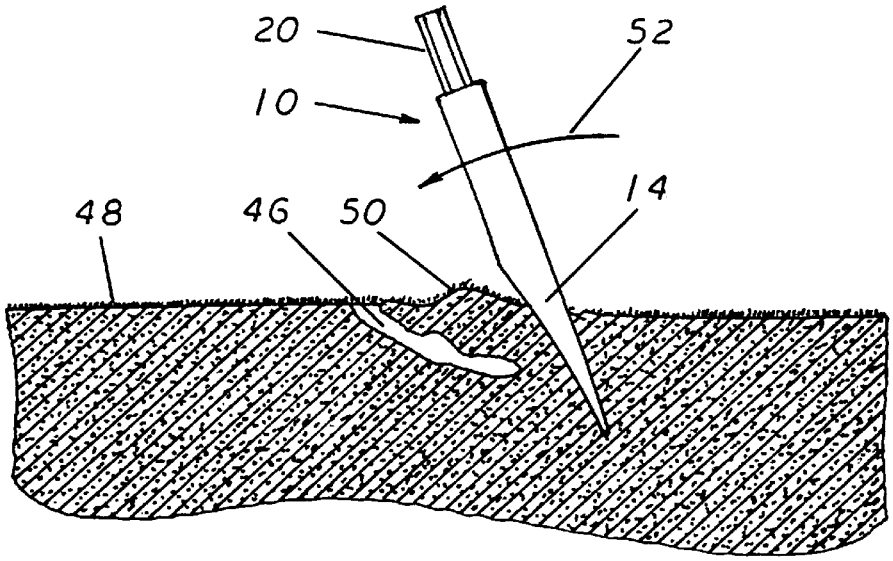
FIG 10

FIG 11
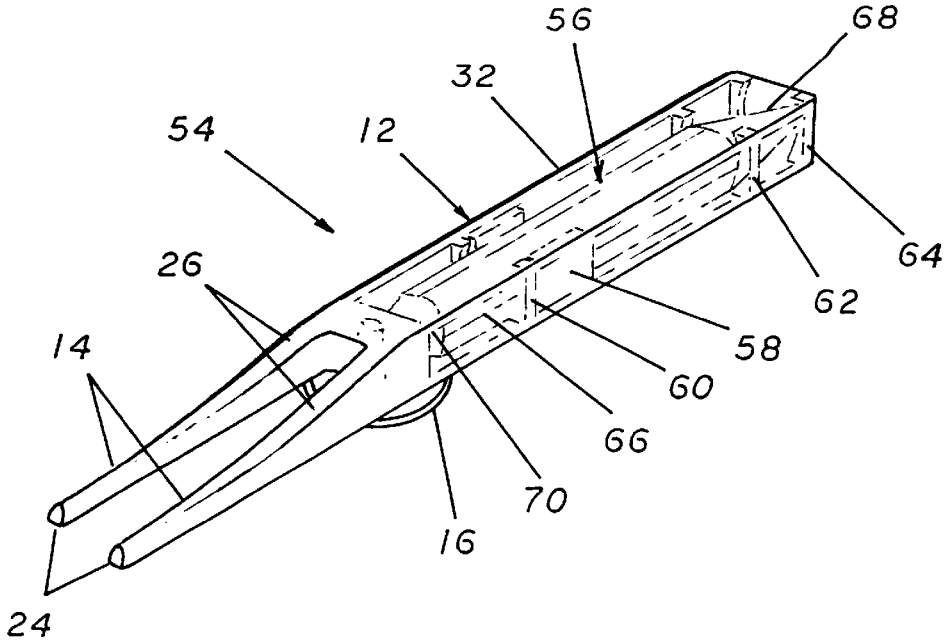
FIG 12
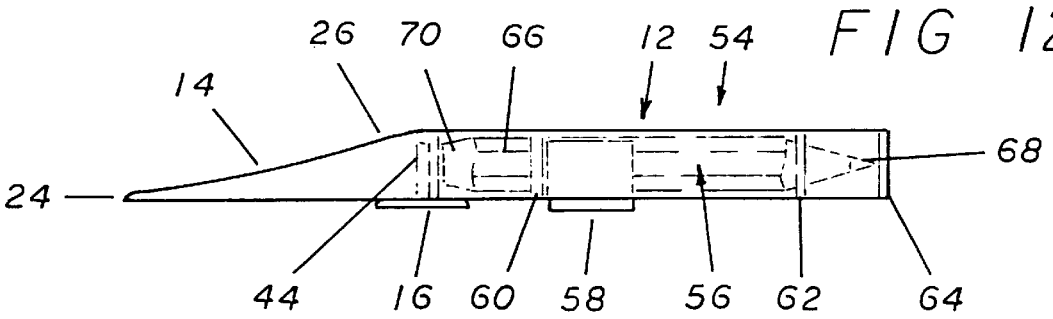
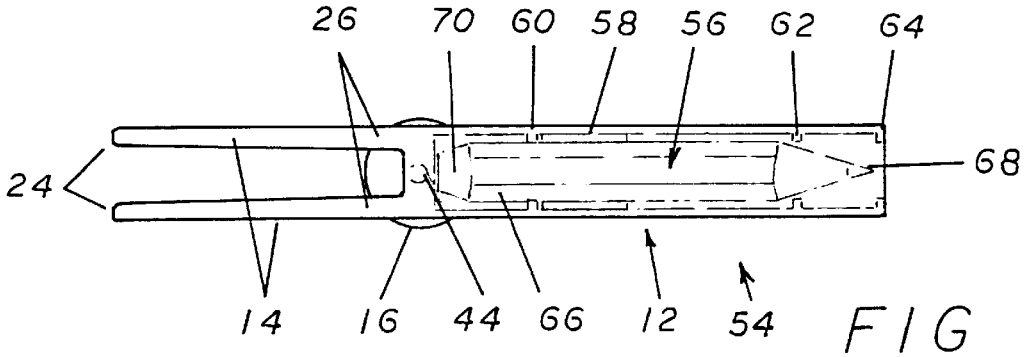
FIG 13

FIG 14
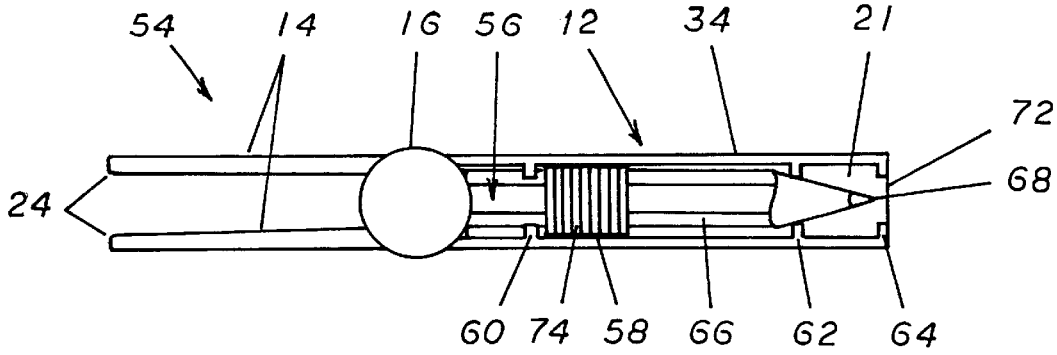
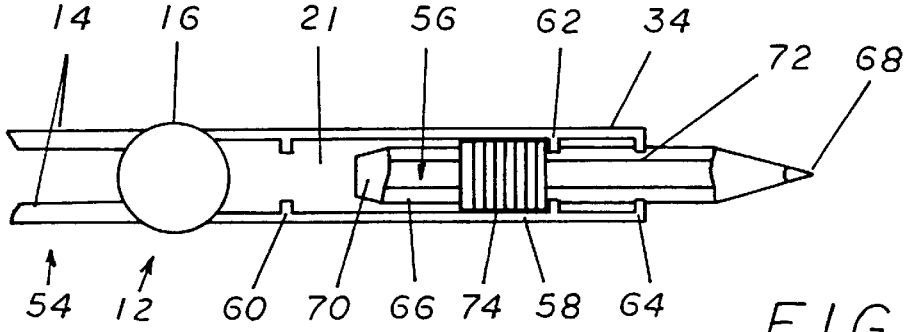
FIG 15
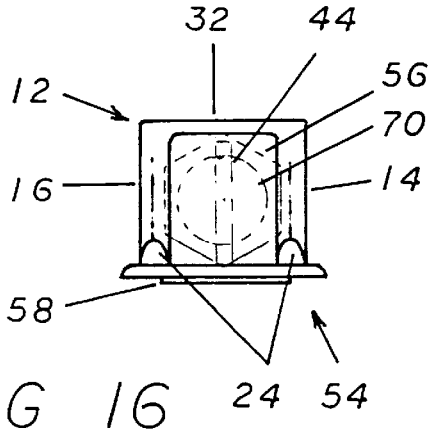
FIG 16
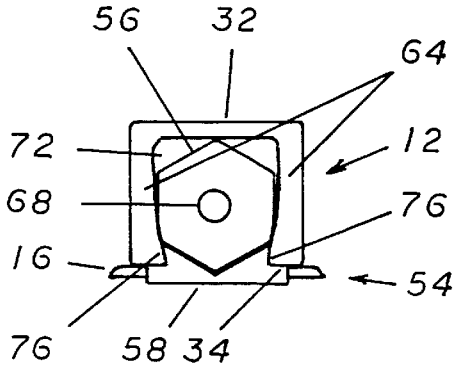
FIG 17

FIG 18
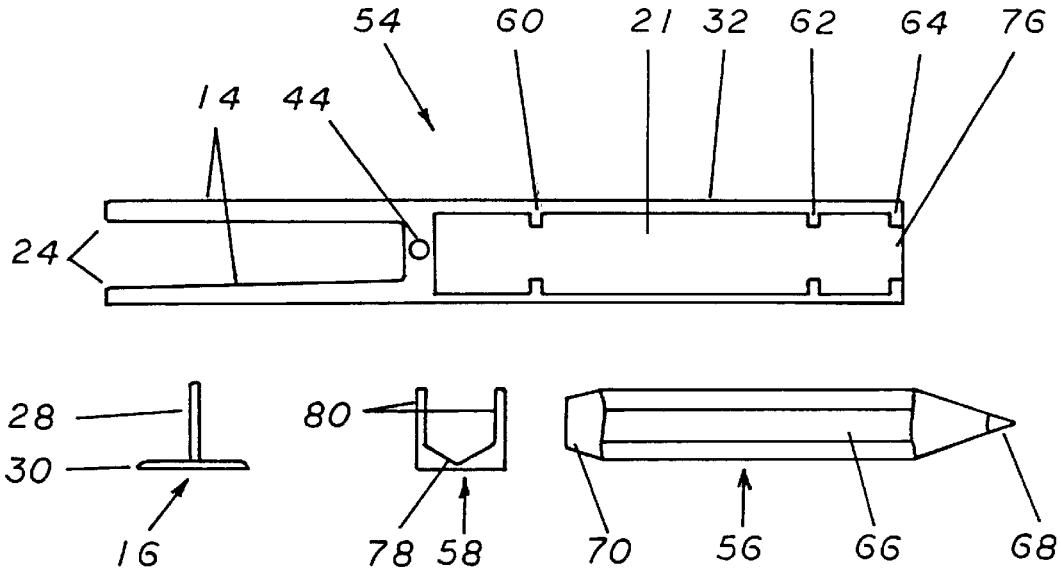
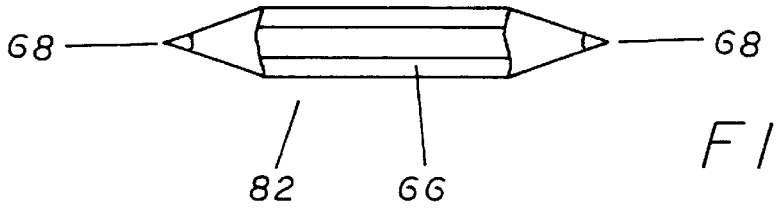
FIG 19

GOLF BALL MARK REPAIR TOOL CONTAINING A SCORING PENCIL

This application is a continuation-in-part of application Ser. No. 09/870,980, filed May 31, 2001 now abandoned and claims the priority of this application.

BACKGROUND OF THE INVENTION

The present invention relates to an improvement in a multi-purpose golfers tool. More specifically, to a tool which may be used to repair ball marks made while golfing and to hold a golfers pencil as used during score keeping.

Many golfing devices currently exist on the market and are known and disclosed in various patent applications and other documents. However, the common tools carried by a golfer have remained the same for quite some time. Typically, a golfer will carry in his pocket a tool for repairing golf ball divots made on a green or other surfaces of the course while playing, a pencil for keeping score and a marker for marking one's ball on the green. As these golf instruments are all quite different, typically they may be kept in separate pockets or in various places in the cart. Often when needed, a golfer must search in his pockets or look in the cart to find the tool. It has been known to combine various golf tools into one instrument in order to prevent loss and increase ease of use for the golfer.

One such tool is shown in U.S. Pat. No. 5,562,553 Diggerness et al. This patent discloses a multi-purpose golfers tool which includes a ball mark repair instrument that is retractable, the body of which contains a pencil sharpener. Although it may be handy to have all these various instruments in one tool, typically, as a small amount of writing is done, the pencil does not need to be sharpened and usually after each round a new pencil may be easily obtained at the club house.

Another device is shown in the Cantlon Design Patent number 327,910. This patent shoes a once piece device having a divot repair tool on one end and a fixed pencil or writing instrument on the other end. This device may be rather dangerous and hard to use because of it's long protruding writing instrument and further, when the writing instrument breaks or becomes empty, it may not be refillable or reusable.

Finally, as the pencils used throughout the golfing industry are rather standard at all courses, it may be particularly desirable to provide an instrument that can use the readily available shortened golfing type pencil.

From this discussion, it can be seen that it would be desirable to provide an instrument that may be used as a golf ball mark repair tool, a tool for containing a golf ball marker and other features. Further, it can be seen that it would be desirable to supply such a tool that may be used to hold a standard type shortened pencil as handed out at most golf courses to easily contain and hold all of these instruments in one location for a golfer to prevent loss and increase ease of use. Such a tool would allow a golfer to concentrate more completely on the game at hand without having to worry about finding or losing golf tools.

SUMMARY OF THE INVENTION

It is the primary objective of the present invention to provide a tool which will allow a golfer to repair the ball mark left by a golf balls impact with the grassy surface of a putting green as a result of the high and relatively long approach shots that are common in the game of golf.

It is an additional objective of the present invention to provide such a tool that will allow a golfer to make such repairs to the surfaces of the greens of golf courses that will also provide a convenient place within which to store scoring pencils or other similar record keeping devices.

It is a further objective of the present invention to provide such a tool that is inexpensive to own and manufacture and easy to use which will ensure its wide use by golfers.

These objectives are accomplished by the use of a tool that is composed of a relatively long and narrow body that is rectangular in cross section and which has at its forward end a pair of continually narrowing tines. Additionally, the body contains a tubular hollowed out cavity that passes from its most rearward surface to a point in the body between the base of the two tines. This central cavity corresponds in size and shape to the commonly used golf scoring pencil and provides a convenient place where a golfer can store his scoring pencil during a round of golf.

The body and tines of the present invention are designed to allow a golfer to lift and repair the divots made in a golf green when a golf ball impacts the soft grass upon the execution of an approach shot by a golfer. This is accomplished by the golfer pushing the tines of the invention into the surface of the green around and behind the impact divot and forcing the damaged turf back over and into the cavity of the ball mark left by the impact of the golf ball on the surface of the putting green. Once this process has been completed the golfer then simply tamps the repaired surface down to level it out and complete the repair procedure.

The body of the present invention also contains a small hole that is drilled through its entirety from the lower surface to the upper surface just behind the most rearward end of the invention's tines. The purpose of this hole is to provide a place on the body of the invention which will allow a golfer to conveniently store a ball marker during a round of golf. A ball marker is generally a small round disc with a perpendicularly stem protruding from its center. It is then used by a golfer to mark the position of his ball on the putting green (generally for ball cleaning purposes) by inserting the pin into the putting surface directly behind the golf ball. The ball marker is stored on the body of the present invention by inserting the pin of the marker into the hole in the body and sliding it in until the disc contacts the lower surface of the invention's body. This configuration holds the ball marker securely when not in use and allows for its easy access by the golfer during all times in a round of golf.

A further embodiment of the present invention uses similar methods of construction to those that have been previously described but employs a pencil that is capable of sliding in and out of the body of the invention without having to remove it completely. This enables a user to quickly deploy the pencil when needed for marking the scorecard while allowing the user to protect the tip from breakage by pulling it back into the body of the invention when it is not in use. The remaining major components of the previous embodiment, such as the divot repair tines and ball marker, are present in this alternative embodiment of the present invention.

The retractable pencil feature of this alternative embodiment of the present invention is made possible by the inclusion of a few altered features. The first of these is that the interior cavity of the body is equipped with a plurality of guide clip apparatuses. These guide clips are wall-like protrusions that bisect the interior cavity of the body in a manner that creates an open-bottomed tube within the body of the alternative embodiment of the present invention that is of such a diameter as to allow for the insertion of a pencil body within it. Additionally, the lower ends of the guide clips extend farther in towards the center of the interior of the body than their centers or upper portions. This creates an opening in the lower surface of the body that is of a slightly smaller width that the width of the pencil. This design allows the pencil to be forced by these protrusions when inserting it into the body while still providing a mechanism that will securely hold it in place during the use of this alternative embodiment of the present invention.

The design of the interior of the invention's body as described above also allows the pencil to be slid both forwards and backwards within the interior without affecting its attachment therein. To facilitate this sliding feature, the body of the pencil is also fitted with a positioning apparatus. The positioning apparatus is a relatively small U-shaped device that is specifically designed and constructed to fit over the pencil tightly enough so that the movement of the positioning apparatus will likewise move the pencil. The outside walls of the positioning apparatus fit over the exterior of the pencil's body and inside of the interior walls of the body of the invention. Additionally, the positioning apparatus also has a grip surface formed at the lower portion of it's U-shaped body that, when properly installed, extends below the lower surface of the invention's body.

Therefore, when a user wishes to extend the pencil for its use, he simply grasps the body in a manner so that he places the ball of his thumb on the surface of the positioning apparatus. By forcing his thumb rearward in relation to the body of the invention, the pencil tip is in turn forced out the rear of the body exposing it for use. Conversely, by pulling the thumb in a rearward manner the pencil is likewise pulled back into the interior to protect it from damage while not in use.

Additionally, this embodiment of the present invention may also use an altered pencil to facilitate its back and forth sliding motion within the interior of the body. The pencil may be modified by sharpening its most rearward end. This sharpening allows the pencil to move in and out of the guide clips easily without encountering the binding problems associated with a blunt ended pencil. The rearward end of the pencil can also be sharpened to a point which provides an additional marking point that can be employed if the other tip is dulled or broken. To utilize the alternative marking point, the pencil is removed from the body, turned around and reinserted with the rearward end of the pencil pointed outward.

For a better understanding of the present invention reference should be made to the drawings and the description in which there are illustrated and described preferred embodiments of the present invention.

DESCRIPTION OF THE DRAWINGS

FIG. 1 is a perspective view of the present invention which illustrates its major components and the manner in which they correspond to one another.

FIG. 2 is a side elevation view of the present invention illustrating the tapering nature of the forward tines and the general positioning of the scoring pencil in relation to the body of the invention.

FIG. 3 is a top elevation view of the present invention illustrating the general manner of construction of the forward tines and the locations of the ball marker mounting hole and the club groove cleaner which are both positioned on the body of the present invention.

FIG. 4 is a rear elevation view of the present invention illustrating the positioning of the scoring pencil within the body of the invention and the manner by which a ball marker is held by the invention.

FIG. 5 is a front elevation view of the present invention illustrating the general orientation of the forward tines in relation to the majority of the body.

FIG. 6 is a side elevation cut-away view of the most rearward portion of the body of the present invention and details the general configuration of the groove cleaner component of the invention.

FIG. 7 is a side elevation view of an alternative embodiment of the present invention in which the scoring pencil is held within an open groove on the bottom surface of the body of the invention.

FIG. 8 is a bottom elevation view of an alternative embodiment of the present invention in which the scoring pencil is held within an open groove on the bottom surface of the body of the invention.

FIG. 9 is a side elevation of the present invention as it is being inserted into the surface of a putting green behind the damaged turf of a ball mark in order to make repairs to the putting surface.

FIG. 10 is a side elevation of the present invention as it is being forced forward which forces the damaged turf back over the ball mark where it can be tamped back down to complete the repair to the putting surface.

FIG. 11 is a perspective view of an alternative embodiment of the present invention which uses a pencil that is mounted in a manner that allows it to be slid forward and rearward for use or storage.

FIG. 12 is a side elevation of the alternative embodiment of the present invention illustrating the position of the pencil and its related components with the body.

FIG. 13 is a top elevation of the alternative embodiment of the present invention illustrating the position of the pencil and its related components with the body.

FIG. 14 is a bottom elevation view of the alternative embodiment of the present invention illustrating the position of the pencil when it is retracted into the body of the invention when not in use.

FIG. 15 is a bottom elevation view of the alternative embodiment of the present invention illustrating the position of the pencil when it is extended beyond the end of the body for use as a scoring tool.

FIG. 16 is a front elevation view of the alternative embodiment of the present invention illustrating the position of the tines in relation to the remaining components.

FIG. 17 is a rear elevation view of the alternative embodiment of the present invention illustrating the orientation of the pencil inside of the pencil cavity illustrating the manner in which the guide nobs are employed to hold the pencil within the body's cavity.

FIG. 18 is a bottom elevation exploded view of the alternative embodiment of the present invention illustrating the manner of construction of major components.

FIG. 19 is a side elevation view of the double sharpened pencil component of the alternative embodiment of the present invention illustrating its manner of construction.

DESCRIPTION OF THE PREFERRED EMBODIMENT

Referring now to the drawings, and more specifically to FIGS. 1, 2, and 3, the golf ball mark repair tool and pencil holder 10 is generally a small fork-like device that is used by golfers to repair the damage left by the impact of their golf balls with the surface of a putting green. Additionally, as implied by the name, the present invention provides the golfer with a convenient place to store a common scoring tracking tool such as a pencil 20 within its body 12. The present invention also provides a point of attachment for the storage of a ball marker 16 commonly used to mark the exact position of a golf ball on the putting green for purpose of cleaning the ball or for the proper observation of golf etiquette.

The present invention is generally made up of a body 12 that is rectangular in its cross section and which also essentially forms the platform upon which the remaining components of the invention are built. The forward end of the body begins to taper down (in relation to the narrow side of its rectangular cross section) in the tine transfer area 26 to the point where the two tines 14 separate and extend forward until they each terminate at their respective tine tips 24. Thus, the tines 14 of the invention form a fork-like apparatus that can be easily forced into the surface of a putting green in order to effectuate repairs to ball damaged areas.

As previously stated, the present invention also provides a point of storage for the common type of pencil 20 used in golf today and which is in fact often given out by a pro shop to its patrons. The storage mechanism employed by the invention is a cylindrical pencil cavity 21 (as shown in FIGS. 4–8) that runs longitudinally down the center of the invention's body 12 and which corresponds in size to the outside diameter of the pencil 20. Access to the pencil cavity 21 is gained through the rear cavity hole 22 located on the rearward surface of the invention's body 12. The rear cavity hole 22 allows the golfer to insert the pencil 20 into the pencil cavity 21 for storage purposes.

The body 12 of the present invention also provides a point of attachment for a ball marker 16. A ball marker 16 is a commonly used device that a golfer employs to mark the position of his golf ball on the surface of the putting green. A ball marker 16 is generally made up of a central disc known as the marker body 30 and a marker pin 28 which is a centrally located within the lower surface of the marker body 30 and which extends perpendicularly therefrom. The ball marker 16 is attached to the body 12 of the invention by placing the marker pin 28 into the marker hole 44 which passes from the lower body surface 34 to the upper body surface 32 just behind the forward cavity opening 36 at the base of the tines 14.

The ball marker 16 is used by the golfer by forcing the marker pin 28 into the surface of the green directly behind the golf ball. This leaves the marker body 30 securely attached to and clearly exposed on the surface of the green leaving the golfer free to remove his ball in accordance with the rules of golf for the purposes of cleaning it or to remove a potential source of interference for other accompanying or competing players.

The body 12 of the present invention also provides the point of attachment along the upper edge of its most rearward surface for the groove cleaner 18. The groove cleaner 18 is a triangular protrusion from the rearward surface of the body 12 (a clearer illustration of the groove cleaner 18 is detailed in FIG. 6) and is used by a golfer to clean debris from the grooves located in the face of golf clubs. This is accomplished by first removing the pencil 20 from the invention so that it does not interfere with the use of the groove cleaner 18. The tip of the groove cleaner 18 is then inserted into one of the club face groove and slid along its length and repeated in all the grooves of the club face until they are all clean. This action removes any debris that may affect the contact between the club face and golf ball during play and so increases the effectiveness of the golf club and the enjoyment of the game to the golfer.

The manner in which the ball marker 16 is attached to the body 12 of the invention is further detailed in FIGS. 4 and 5 and is accomplished by engaging the marker hole 44 with the marker pin 28 of the ball marker 16. Pressure is then applied to the marker body 30 until the marker pin 28 has slid entirely into the marker hole 44 and the marker body 30 comes into contact with the lower body surface 34 of the present invention. The ball marker 16 can then be removed for use by simply pulling the marker pin 28 from the marker hole 44 to the point that it comes free from the body 12 of the invention.

An alternative embodiment of the present invention is illustrated in FIGS. 7 and 8 which illustrate a snap in pencil ball mark repair tool 38 which differs from the previous embodiment primarily in the manner used to attach the pencil 20 to the body 12 of the invention. While the previous embodiment employed the use of an enclosed pencil cavity 21, the present embodiment uses an open lower surface 40 resulting in a pencil cavity 21 that is open on the bottom. The pencil 20 is held within the pencil cavity 21 by the use of the pencil grips 42 which are slight protrusions along each inside bottom edge of the pencil cavity 21. The result of the use of the pencil grips 42 is that they reduce the actual size of the opening in the pencil cavity 21 just enough so that it takes a bit of pressure to force the pencil 20 into the pencil cavity 21. Conversely, once the pencil 20 is in place within the pencil cavity 21, it will remain there unless enough force is applied to get it past the protruding pencil grips 42.

The manner in which the present invention is used to repair a ball mark 46 made in a putting surface 48 is illustrated in FIGS. 9 and 10 which show a typical ball mark 46 and the resulting damaged turf 50. The repair of this condition is accomplished by inserting the tines 14 of the present invention into the putting surface 48 just behind the damaged turf 50 at a slight angle so that the top of the invention, where the pencil 20 protruding, is in a position so that it is pointing away from the ball mark 46.

Once the proper positioning of the invention has been accomplished, the upper portion of the invention is forced forward (indicated by the directional arrow 52 in FIG. 10) which pushes the damaged turf 50 back over the ball mark 46. This process is continued around the exterior of the ball mark 46 until all the damaged turf 50 is pushed back into place. The repair is completed by the golfer simply tamping the damaged turf 50 back into place with the sole of his putter or shoe so that the putting surface 48 is again level.

A still further alternative embodiment of the present invention is illustrated in FIGS. 11, 12, and 13 which detail the manner of construction of the retractable pencil ball mark repair tool 54. For purposes of illustration the retractable pencil ball mark repair tool 54 is shown as being constructed of a transparent material but it should be noted that a broad range of suitable materials can be used for this purpose. The retractable pencil ball mark repair tool 54 is very similar in both construction and operation as the embodiment of the invention described above and contains many features in common such as the ball marker 16, the tines 14, the tine tips 24, and the tine transfer areas 26. The primary differences in the embodiments of the present invention are the manner in which the scoring tool is fixed within the body 12 and the manner in which it is employed for its use as a scoring tool.

The retractable pencil ball mark repair tool 54 uses a rear tapered pencil 56 which is made up of a central pencil body 66, a sharpened pencil tip 68, and a rear pencil taper 70. The rear pencil taper 70 fits into the body 12 of the invention within the pencil cavity 21 in much the same fashion as with the previous embodiment. However, the method by which it is maintained within the pencil cavity 21 differs significantly. The pencil cavity 21 in this alternative embodiment of the invention contains a plurality of short pairs of walls that protrude from the interior walls of the body 12 into the pencil cavity 21. These features include the forward guide clip 60 located towards the forward portion of the pencil cavity 21, the middle guide clip 62 located in the rear portion of the pencil cavity 21 but in a location that is forward of the most rearward surface of the body 12, and the rearward guide clip 64 located at the rear of the body 12. The forward, middle, and rearward guide clips, 60, 62, and 64, are formed in such a manner so that they allow the pencil body 66 to be snapped into place while also holding it securely enough so that it will remain within the pencil cavity 21 until purposefully removed.

The retractable pencil ball mark repair tool 54 also contains a device that is specifically incorporated to enhance the retractable nature of the rear tapered pencil 56. This component is called the pencil position slide 58 which fits over the pencil body 66 within the pencil cavity 21. The pencil position slide 58 is the component of the invention that the user employs to extend and retract the rear tapered pencil 56 from the body 12 which will be described in further detail in the text below.

The manner in which the rear tapered pencil 56 slides in and out of the pencil cavity 21 through the pencil opening 72 located at the rear most surface of the body 12 of the invention is further detailed in FIGS. 14 and 15. In FIG. 14 the rear tapered pencil 56 is illustrated in the retracted or stored position with the pencil tip 68 pulled back past the pencil opening 72. The position of the pencil position slide 58 relative to the pencil body 66 and the forward guide clip 60 is detailed as the pencil position slide 58 is oriented on the pencil body 66 so that, in the retracted position, its forward surface butts against the forward guide clip 60. This positioning ensures that the greatest amount of rearward travel can be imparted to the rear tapered pencil 56 when the user wants to extend it for score marking purposes.

Conversely, when the rear tapered pencil 56 is extended, the pencil position slide 58 moves rearward within the pencil cavity 21 until its rearward surface comes into contact with the middle guide clip 62. The contact of these two components stops the travel of the rear tapered pencil 56 in a location that allows it to be easily and effectively used as a score marking device. Additionally, the lower surface of the pencil position slide 58 is equipped with a plurality of ridges called the position slide grip surface 74 which enables the user to engage it firmly during the extension and retraction of the rear tapered pencil 56. The purpose of the rear pencil taper 70 is also further illustrated showing how it helps keep the pencil body 66 properly aligned within the pencil cavity 21 as it slides back and forth within the forward, middle, and rearward guide clips, 60, 62, and 64.

Additionally, the importance of the positions of the forward, middle, and rearward guide clips, 60, 62, and 64, relative to the body 12 of the invention are further detailed. With the rear tapered pencil 56 fully retracted, the pencil body 66 is engaged only by the forward and middle guide clips, 60 and 62. This not only securely holds the rear tapered pencil 56 in the retracted position, but also provides a track of sorts which guides it during its extension and retraction. Conversely, when the rear tapered pencil 56 is extended for use, the pencil body 66 is only held by the middle and rearward guide clips, 62 and 64. The position of the middle guide clip 62 at a point that is some distance from the rear surface of the invention's body 12 provides a wide enough base to securely hold the rear tapered pencil 56 in the extended position. Thus, the design of the forward, middle, and rearward guide clips, 60 62, and 64, allow the rear tapered pencil 56 to be secured within the body 12 while providing a mechanism by which it can slide back and forth. They also limit its travel by engaging the front and back surfaces of the pencil position slide 58.

The position of the rear tapered pencil 56 within the body 12 of the invention and the manner by which it is held in place are further detailed in FIGS. 16 and 17. These FIGS. illustrate the location of the rear tapered pencil 56 and its pencil tip 68 and rear pencil taper 70 relative to the other components of the invention including the tines 14, the tine transfer area 26, the tine tips 24, the upper and lower body surfaces, 32 and 34, and the pencil opening 72 when taken from a front and rear view. Most importantly, the configuration of the rearward guide clip 64, which is identical in construction to the forward and middle guide clips, 60 and 62, contains two inwardly protruding guide knobs 76 that are located on their lower surfaces and extend slightly into the lower portion of the pencil cavity 21. This configuration closes off the opening in the lower body surface 34 enough so the rear tapered pencil 56 can be forced by the guide knobs 76 during its installation or removal but they hold their form well enough to hold the rear tapered pencil 56 within the pencil cavity 21 under normal use circumstances. Additionally, the position of the pencil position slide 58 relative to the rear tapered pencil 56 and the invention's body 12 is also illustrated.

The individual components of the retractable pencil ball mark repair tool 54 are further illustrated in FIG. 18 which details the manner of construction of its body 12, the ball marker 16, the pencil position slide 58, and the rear tapered pencil 56. As previously described, the ball marker 16 is made up of a marker pin 28 and a marker body 30 and is attached to the body 12 by inserting the marker pin 28 into the marker hole 44 located just rearward of the tines 14. The pencil position slide 58 is a U-shaped apparatus that contains two open vertical sides 80 which fit around the pencil body 66 and a pencil body alignment surface 78 located at the interior bottom of the pencil position slide 58. The pencil body alignment surface 78 is formed to match the contours of the pencil body 66 and works in conjunction with the sides 80 to hold the rear tapered pencil 56 in a secure manner during the use of the invention. The form and manner of operation of the rear tapered pencil 56 have been discussed in detail above.

Finally, an alternative double sharpened pencil 82 is illustrated in FIG. 19. The double sharpened pencil 82 has both of its ends sharpened into a writable pencil tip 68 which allows the user to remove it and turn it around in the event that one of the pencil tips 68 becomes broken or dulled during its use. The use of the double sharpened pencil 82 allows the user to employ the invention without the need for carrying spares during a round of golf.

Although the present invention has been described in considerable detail with reference to certain preferred versions thereof, other versions are possible. Therefore, the spirit and scope of the appended claims should not be limited to the description of the preferred versions contained herein.

What is claimed is:

1. A golf ball mark repair tool comprising:

an elongate body having a top end and a bottom end and an outer surface between said top and bottom end;

a first and second tine section formed at said bottom end of said elongate body said tines extending outward from said elongate body substantially parallel to said elongate body;

a cavity for receiving and holding a writing instrument defined by said elongate body, said cavity starting at said top end of said elongate body and extending through a substantial portion of said elongate body toward said bottom end;

a writing instrument removably contained within said cavity for receiving and holding said writing instrument;

a U shaped position slide removably attached to said writing instrument; and a plurality of pencil grips extending outward in said cavity for holding a writing instrument.

2. A golf ball mark repair tool as in claim 1 further comprising a marker receiving hole defined by said elongate body said marker receiving hole extending into said elongate body perpendicular to said body.

3. A golf ball mark repair tool as in claim 2 further comprising a ball marker held in said marker receiving hole.

4. A golf ball mark repair tool as in claim 3 further comprising a groove cleaner extending outward from said top end of said elongate body.

5. A golf ball mark repair tool comprising:

an elongate body having a top end and a bottom end and an outer surface between said top and bottom end;

a first and second tine section formed at said bottom end of said elongate body said tines extending outward from said elongate body substantially parallel to said elongate body;

a cavity for receiving and holding a writing instrument defined by said elongate body, said cavity starting at said top end of said elongate body and extending through a substantial portion of said elongate body toward said bottom end, said cavity has an opening at said top end of said elongate body said opening extends along the outer surface of said elongate body toward said bottom end so as to form a valley shaped opening along said elongate body for receiving a writing instrument;

a U shaped position slide removably slideable in said valley shaped opening; and a plurality of guide clips within said cavity extending outward from said valley shaped opening.

6. A golf ball mark repair tool as in claim 5 wherein said guide clips limit the travel of said U shaped position slide.

7. A golf ball mark repair tool as in claim 6 further comprising a marker receiving hole defined by said elongate body said marker receiving hole extending into said elongate body perpendicular to said body.

8. A golf ball mark repair tool as in claim 7 further comprising a ball marker held in said marker receiving hole.

9. A golf ball mark repair tool as in claim 8 further comprising a groove cleaner extending outward from said top end of said elongate body.

10. A golf ball mark repair tool as in claim 9 further comprising a writing instrument removably contained within said cavity for receiving and holding said writing instrument.

11. A golf ball mark repair tool comprising:

an elongate body having a top end and a bottom end and an outer surface between said top and bottom end;

a first and second tine section formed at said bottom end of said elongate body said tines extending outward from said elongate body substantially parallel to said elongate body;

a cavity for receiving and holding a writing instrument defined by said elongate body, said cavity starting at said top end of said elongate body and extending through a substantial portion of said elongate body toward said bottom end, said cavity has an opening at said top end of said elongate body said opening extends along the outer surface of said elongate body toward said bottom end so as to form a valley shaped opening along said elongate body for receiving a writing instrument;

a writing instrument removably contained within said cavity for receiving and holding said writing instrument; and a U shaped position slide attached to said writing instrument.

12. A golf ball mark repair tool as in claim 11 further comprising a marker receiving hole defined by said elongate body said marker receiving hole extending into said elongate body perpendicular to said body.

13. A golf ball mark repair tool as in claim 12 further comprising a ball marker held in said marker receiving hole.

14. A golf ball mark repair tool as in claim 13 further comprising a groove cleaner extending outward from said top end of said elongate body.

* * * * *